US005148573A

United States Patent [19]

Killian et al.

[11] Patent Number: 5,148,573

[45] Date of Patent: Sep. 22, 1992

[54] APPARATUS FOR ATTACHING A CLEANING TOOL TO A ROBOTIC MANIPULATOR

[76] Inventors: Mark A. Killian, 102 Foxhunt Dr., North Augusta, S.C. 29841; W. Thor Zollinger, 3927 Almon Dr., Martinez, Ga. 30907

[21] Appl. No.: 754,839

[22] Filed: Sep. 4, 1991

[51] Int. Cl.[5] ..... A47L 9/00

[52] U.S. Cl. ..... 15/339; 15/410; 901/41; 483/69

[58] Field of Search ..... 15/339, 410; 901/41; 29/568

[56] References Cited

U.S. PATENT DOCUMENTS

| | | | |
|---|---|---|---|
| 4,374,024 | 2/1983 | Peloquin et al. | 210/241 |
| 4,416,577 | 11/1983 | Inaba et al. | 15/304 X |
| 4,635,328 | 1/1987 | Palmer | 901/41 X |
| 4,781,519 | 11/1988 | Monforte | 901/41 X |
| 4,959,146 | 9/1990 | Kristan | 210/237 |
| 5,018,266 | 5/1991 | Hutchinson et al. | 901/41 X |
| 5,044,063 | 9/1991 | Voellmer | 29/568 |

*Primary Examiner*—Chris K. Moore

*Attorney, Agent, or Firm*—Harold M. Dixon; William R. Moser; Richard E. Constant

[57] ABSTRACT

An apparatus for connecting a cleaning tool to a robotic manipulator so that the tool can be used in contaminated areas on horizontal, vertical and sloped surfaces. The apparatus comprises a frame and a handle, with casters on the frame to facilitate movement. The handle is pivotally and releasibly attached to the frame at a preselected position of a plurality of attachment positions. The apparatus is specifically configured for the KELLY VACUUM SYSTEM but can be modified for use with any standard mobile robot and cleaning tool.

20 Claims, 5 Drawing Sheets

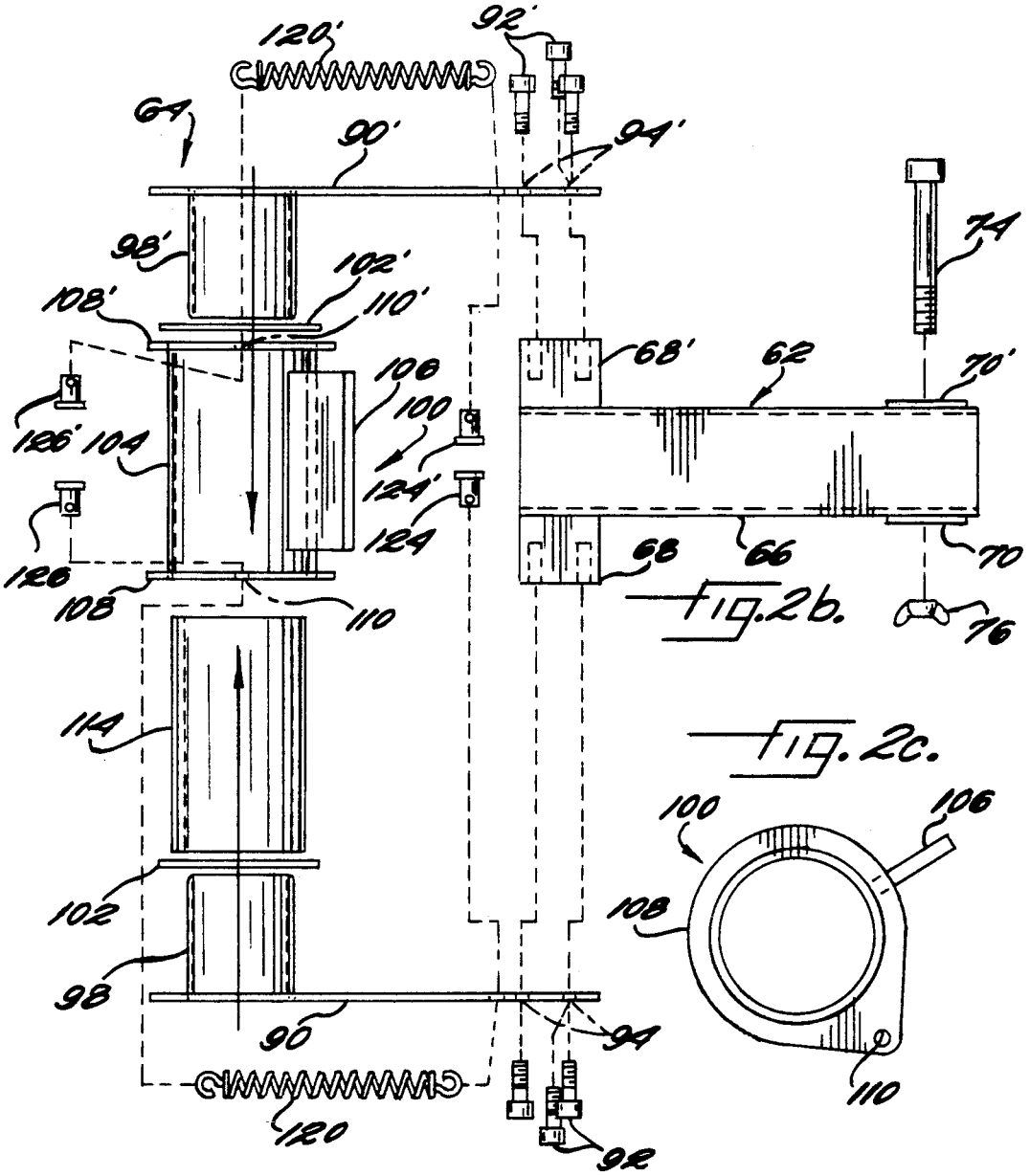
fig. 2b.
fig. 2c.
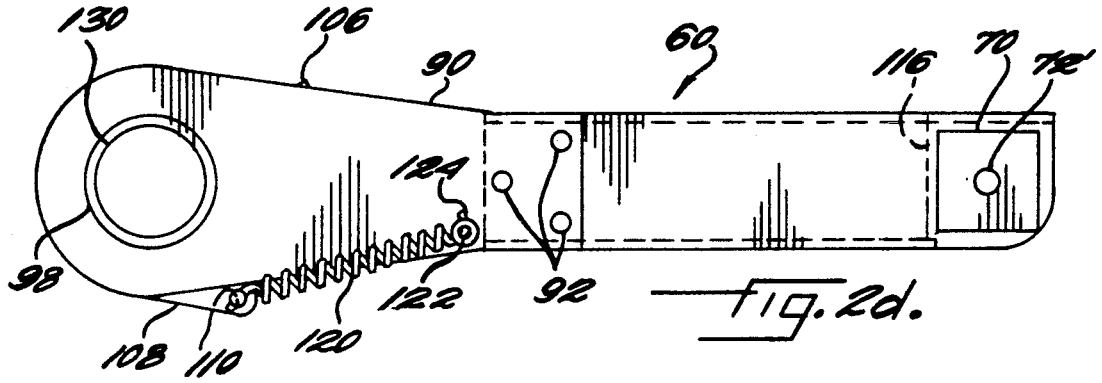
fig. 2d.

APPARATUS FOR ATTACHING A CLEANING TOOL TO A ROBOTIC MANIPULATOR

The United States Government has rights in this invention pursuant to Contract No. DE-AC09-89SR18035 between the U.S. Department of Energy and Westinghouse Savannah River Company.

BACKGROUND OF THE INVENTION

1. Field of the Invention

The present invention relates to remotely-operated cleaning tools. In particular, the present invention relates to apparatus for attaching a vacuum cleaning tool to a robotic manipulator.

2. Discussion of Background

Processing facilities for hazardous materials, including radioactive materials, often require cleaning and decontamination of floors and walls. This is usually accomplished by well-known methods, using brushes, mops, sponges, and so forth. Vacuuming is used where feasible to remove dust, small objects, and other debris. Most such cleaning is done manually, since little appropriate, remotely-controlled apparatus is available. Persons doing this work must take appropriate precautions against excessive radiation exposure, including wearing protective clothing, using respirators, and observing time limits working in the area.

A conventional vacuum cleaner deposites the vacuumed dust and debris into a bag. Some vacuum cleaner bags are reusable; more commonly, a conventional vacuum cleaner bag is discarded and replaced with a fresh bag. Most vacuum cleaners are not suitable for use in environments where hazardous materials may be present. Fabric or paper bags supplied for typical vacuum cleaners do not effectively confine radioactive or other hazardous materials because some of the dust escapes back to the ambient air during vacuuming and some accumulates on surfaces of the vacuum cleaner itself. Furthermore, the operator must open the unit to exchange filter bags. In the process of handling the dust bag during bag replacement, additional dust escapes. For these reasons, conventional vacuum cleaners are unsuitable for vacuuming radioactive particles and dust.

Vacuum cleaners designed for use with radioactive materials are available. These typically draw the debris through a high efficiency particulate absorbing (HEPA) filter and contain the filtered material in a filter unit for subsequent disposal. The filter unit prevents the escape of filtered radioactive particles—or any other hazardous materials in the debris—to the atmosphere during operation, as well as during removal of the filter unit. Vacuum steam cleaners inject superheated water onto the surface to be cleaned. The water flashes to steam upon contact with the surface and is vacuumed immediately by the cleaner. Container Products Corporation manufactures a particular vacuum steam cleaner sold under the trademark "THE KELLY DECON SYSTEM".

Cleaning and decontaminating an area containing hazardous materials is preferably accomplished by remotely-controlled apparatus. A Kelly Decon System robotic floor cleaner is available. However, tools for decontaminating walls and other vertical or sloping surfaces must still be operated manually, increasing the likelihood of operator exposure to any hazardous materials in the area.

Numerous remotely-controlled suction devices for cleaning swimming pools are available. These are not, however, suitable for use in an environment where hazardous materials may be present. Remotely-operated apparatus for collecting debris from nuclear pools is also known. See Kristan, U.S. Pat. No. 4,959,146, and Peloquin et al., U.S. Pat. No. 4,374,024. The Peloquin device is an underwater suction device with a gripper and a variable position latching mechanism attached to a pole. The operator positions the device manually by moving the pole to the desired location. The device is designed for removing small objects and debris. While it can be rotated to positions other than horizontal, it is not practical for systematic vacuuming of floors and walls. Kristan ('146) provides an underwater suction device with a pivoting pick-up head that resembles a vacuum cleaner attachment with a brush. The operator uses a probe pole to maneuver the pickup head along the pool floor. A wand-type suction head is used for corners and hard-to-reach places. Neither of these devices is adapted for use with a robotic gripper.

SUMMARY OF THE INVENTION

According to its major aspects and broadly stated, the present invention is an apparatus for enabling a robotic manipulator to maneuver a cleaning tool on horizontal, vertical and sloped surfaces. The apparatus has a frame and a handle. The frame has side members, a rear member, a central support member and post braces. A post having two substantially perpendicular holes extending therethrough is attached to the post braces. Corner braces are mounted in the corners formed between the rear member and side members. Casters attached to the corner braces provide a stable, readily movable base. The handle has front and rear sections. The front section is pivotally attached to the post by a quick-release pin inserted through one of the holes. The rear section of the handle bears a rotatable, cylindrical bail having a gripper stop adapted to be gripped by a conventional manipulator. The manipulator can thus move the vacuum tool in a plane, raise or lower the tool to clean surfaces differing heights, and pivot the handle about the frame to facilitate cleaning under objects such as tables and projecting shelves.

Any standard mobile robot and vacuum system can be adapted for use with the apparatus. For example, THE KELLY DECON SYSTEM can be used with the present invention. No modifications to THE KELLY DECON SYSTEM are required. By suitably controlling the robot and its manipulator arm, an operator can decontaminate horizontal, vertical, or sloped surfaces without exposure to hazardous material which may be present in the area.

An important feature of the present invention is the frame. The frame supports a cleaning tool and a handle to be gripped by a robotic manipulator. The frame can readily be sized to carry different-sized tools, including the KELLY DECON SYSTEM 6" (15.2 cm) wall cleaning tool and 12" (30.5 cm) floor cleaning tool. If convenient, the frame may hold two 6" Kelly wall cleaning tools.

Another feature of the present invention is the handle. The front section of the handle is pivotally attached to the post by a quick release pin. The rear section of the handle bears a pivot assembly including a rotatable cylindrical bail and a bushing. The bail has a gripper stop adapted to be gripped by a conventional manipulator. The bushing facilitates rotation of the bail by preventing binding. The bushing is preferably of a metal or alloy containing entrained oil, such as OILITE® bronze or some low friction material having similar properties. Stress or surface wear releases the oil, so additional lubrication is not needed.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 2*b* is an exploded view of the link arm of the handle of FIG. 2*a;*

FIG. 2*c* is a side view of the pivot of the handle of FIG. 2*a;*

FIG. 2*d* is a side view of the handle shown in FIG. 2*a;*

DETAILED DESCRIPTION OF A PREFERRED EMBODIMENT

Figure 1A:
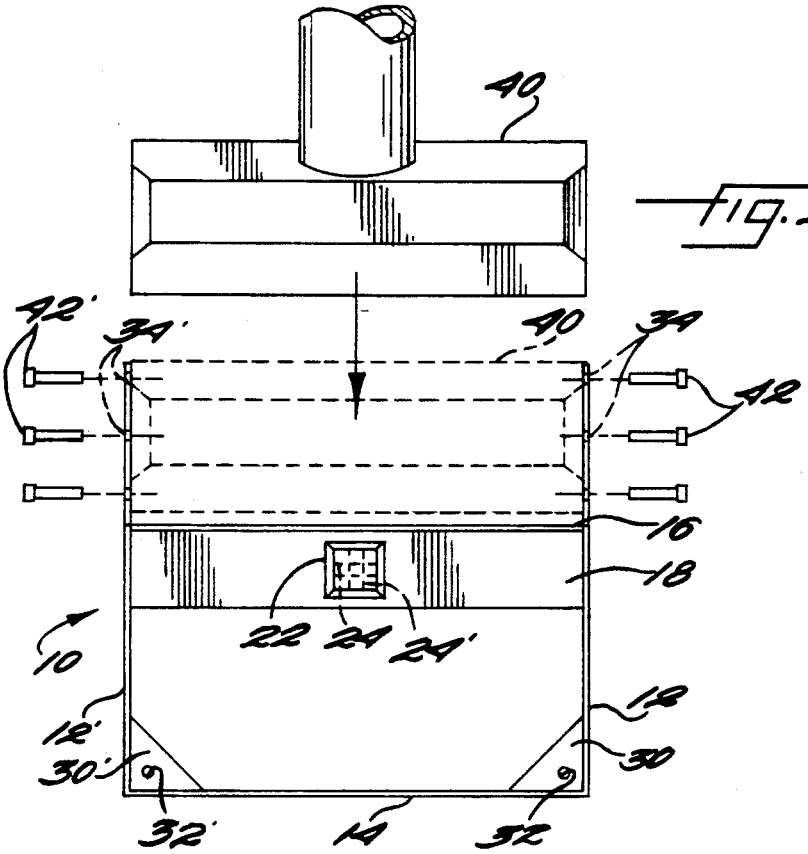
FIG. 1*a* is a top view of the frame of an apparatus according to a preferred embodiment of the present invention.

Referring now to FIG. 1*a*, there is shown a top view of a frame assembly according to a preferred embodiment of the present invention. Frame assembly 10 has substantially parallel side members 12, 12', rear member 14, central support member 16, and post braces 18 and 20 (FIG. 1*a*). Side members 12, 12' measure approximately 11"×2" (27.9×5.1 cm), and central support member 16 and post braces 18, 20 approximately 12"×2" (30.5×5.1 cm). Thus, frame 10 is sized to accommodate a 12" (30.5 cm) Kelly Decon System vacuum tool illustrated in FIG. 1*a* and indicated by reference character 40.

Post 22, 3.62" (9.2 cm) high with a generally square cross-section of 1.5" (3.8 cm), is attached to braces 18 and 20. Post 22 has two holes 24, 24' extending therethrough. Holes 24, 24' are centered on post 22, about 0.5" (1.27 cm) from the top of post 22 and are perpendicular to each other. Corner braces 30, 30' having holes 32, 32', are mounted in the corners formed by rear member 14 and side members 12, 12'. Braces 30, 30' may be triangular with a 2" (5.1 cm) side, as shown, or of some other convenient shape and size for bracing frame 10. Side members 12, 12' each carry holes 34, 34'.

Figure 1B:
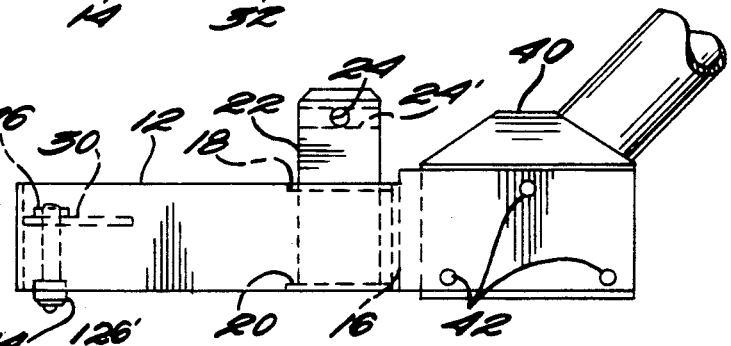
FIG. 1*b* a side view of the apparatus of FIG. 1*a;*

Kelly Decon System vacuum tool 40 is attached to frame 10 by bolts 42, 42' through holes 34, 34'. Alternatively, vacuum tool 40 may be attached by some other convenient means such as screws or rivets. As best seen from the side view of FIG. 1*b*, casters 44 (only one visible in FIG. 1*a*) are mounted to holes 32, 32', secured by nuts 46. Casters 44 enable vacuum tool 40 to move easily over surfaces.

Frame 10 is made of a material suitable for use in an environment containing hazardous and/or radioactive materials, preferably ⅛" (0.318 cm) stainless steel. Frame 10 is assembled by welding, or, if convenient, another means such as bolts or rivets. Frame 10 has a generally rectangular shape. However, it will be understood that frame 10 may take some other shape and still accommodate a Kelly Vacuum System or other steam vacuum system. For example, side members 12, 12' and rear member 14 may be replaced by a generally "U"-shaped member.

Figure 2A:
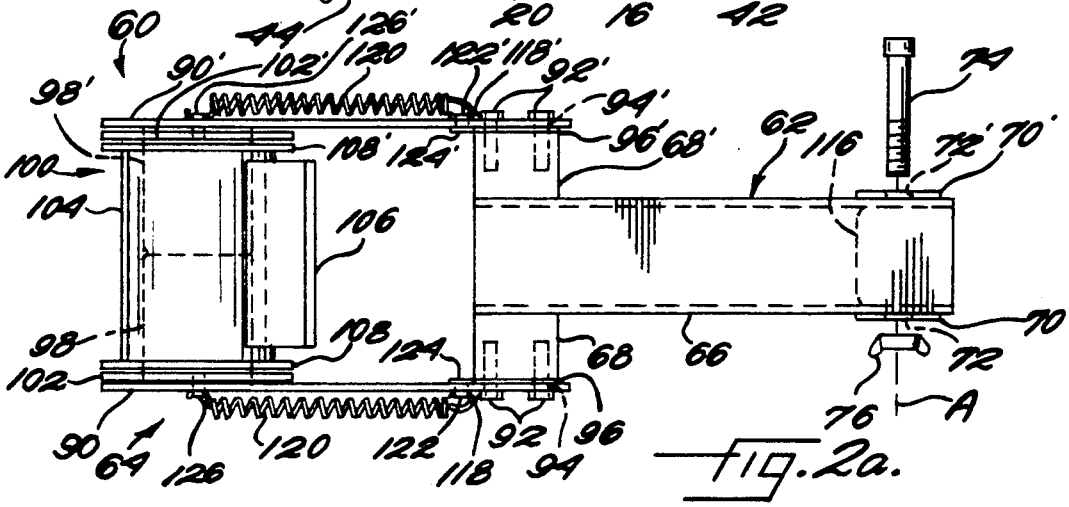
FIG. 2*a* is a top view of the handle according a preferred embodiment of the present invention.

As seen in FIG. 2*a*, handle assembly 60 has front link end 62 and rear link arm 64. Link end 62 comprises tube 66 of generally square cross section, having flanges 68, 68' and reinforcing plates 70, 70'. Tube 66 is ⅛" (0.318 cm) aluminum, 8.625" (21.9 cm) long and 1.75" (4.5 cm) in diameter. Plates 70, 70" are approximately square, with sides approximately 1.5" (3.8 cm). Holes 72, 72' through plates 70, 70' and tube 66 are adapted to receive pin 74. Link end 62 is pivotally attached to one of holes 24, 24' of frame 10 by pin 74. Opening 116 allows end 62 to pivot about post 22. Preferably, pin 74 is a screw or quick release pin secured by wing nut 76. Handle 60 is attached to frame 10 by placing tube 66 over post 22 and pin 74 through either hole 24 or 24'.

Link arm 64 has side members 90, 90' attached to link end 62 by screws 92, 92' through holes 94, 94'. If desired, arm 64 may be bolted or riveted to end 62. Link arm 64 is of ⅛" (0.318 cm) stainless steel, about 8.5" (21.6 cm) long. Spacers 96, 96' separate link end 62 and side members 90, 90'. Pivot tubes 98, 98' are attached to side members 90, 90' by welding or other means.

Pivot assembly 100 is rotatably mounted on pivot tubes 98, 98', separated from side members 90, 90' by washers 102, 102', as best seen in the exploded view shown in FIG. 2*b*. Washers 102, 102' are preferably made of TEFLON® or similar material. A pivot assembly 100 surrounds pivot tubes 98, 98' and has a cylindrical bail 104 carrying a gripper stop 106. Two end stops 108, 108' having holes 110, 110' (FIG. 2*a* and 2*c*) are attached to opposing end of bail 104. A side view of pivot assembly 100 is shown in FIG. 2*c*. Low friction bushing 114 is interposed between bail 104 and pivot tubes 98, 98' (FIG. 2*a*). Bushing 114 facilitates rotation of bail 104 by preventing binding. Preferably, bushing 114 is made of a metal or alloy containing oil entrained therein, such as OILITE® bronze. Stress or surface wear releases the oil, so additional lubrication is not needed. Alternatively, bushing 114 is of any low friction material having the desired lubricating properties.

Springs 120, 120' are attached at one end to holes 122, 122' of spring pins 124, 124' in holes 118, 118' (FIG. 2*a*). Springs 120, 120' are attached at the other ends to holes 110, 110' of end stops 108, 108' with spring pins 126, 126'. If convenient, springs 120, 120' may be attached to one pair of bolts 92, 92' instead of pins 124, 124'. A side view of handle 60 is shown in FIG. 2*d*. Pivot tubes 98,

98′ (only pivot tube 98 is visible in FIG. 2*d*) are mounted on side members 90, 90′, coaxially with holes 130, 130′.

Pivot tubes 98, 98′ are each 2.375″ (6.0 cm) long, of 2″ (5.1 cm) outside diameter. Bail 104 is 4.35″ (11.1 cm) long with 2.75″ (7.0 cm) outside diameter, gripper stop 106 measures 3.5″×1.5″×0.25″ (8.3×3.8×0.64 cm), and end stops 108, 108′ have outside diameters 1.75″ (4.45 cm). Bushing 114 is 4.35″ (11.1 cm) long, with 2.5″ (6.4 cm) outside diameter and 2″ (5.1 cm) inside diameter. All dimensions are approximate and sized for a Kelly Vac System. It will be evident that pivot assembly 100 and gripper stop 106 may be of any shape and size adapted to be gripped by a conventional manipulator without departing from the spirit of the present invention.

In use, handle assembly 60 is secured to frame 10 so that holes 72, 72′ are aligned with hole 24 or hole 24′, as may be most convenient for the operator. Pin 74 is inserted through holes 72, 72′ and either hole 24 or 24′ to secure handle assembly 60 to frame 10. The combination of handle assembly 60 and frame 10 forms apparatus 140, shown in use in FIG. 3. Vacuum tool 40 is first attached to frame 10 by screws 42, 42′, as described above. Then springs 120, 120′ are connected between holes 110, 110′ and spring pins 124, 124′ or more pair of bolts 92, 92′.

Figures 3A, 3B:
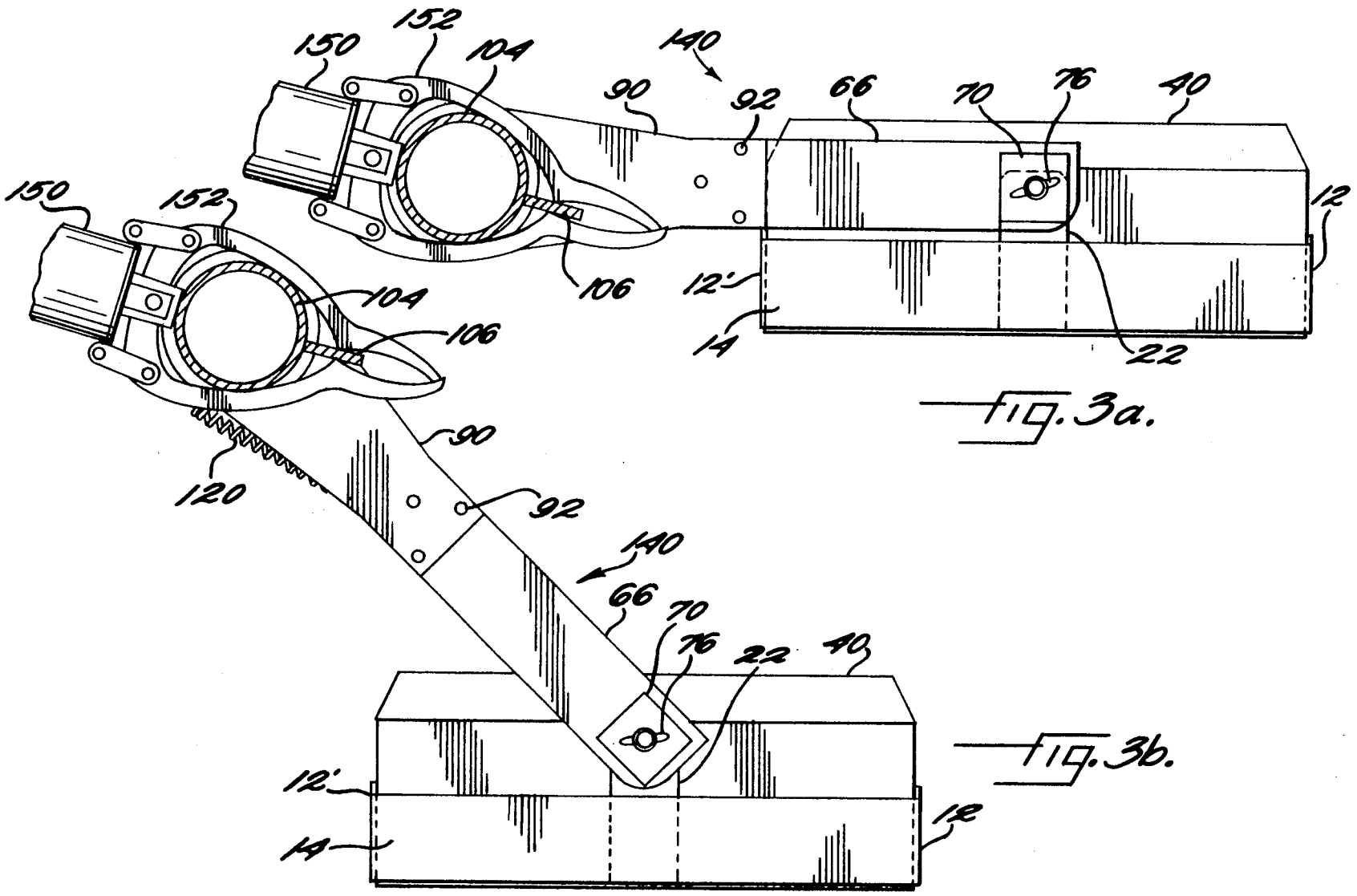
FIG. 3*a* is a view of an apparatus used with a robotic manipulator and cleaning tool according to a preferred embodiment of the present invention.
FIG. 3*b* is a view of the apparatus shown in FIG. 3*a* with the handle rotated.

As shown in FIG. 3, robot arm 150 terminates in manipulator 152 which encloses bail 104 and grasps gripper stop 106. Preferably, robot arm 150 can move manipulator 152 linearly in three dimensions and rotate manipulator 152 about at least one axis (shown as line A in FIG. 2*a*). Manipulator 152 can thereby move vacuum tool 40 in a plane, and raise or lower vacuum tool 40 to clean surfaces of differing heights such as platforms, stairs, table tops, shelves, and so forth. As will be seen by comparing FIGS. 3*a* and 3*b*, manipulator 152 and handle assembly 60 may also rotate between position 1 and position 2 as handle 60 pivots about frame 10 on pin 74 and bail 104 rotates about pivot tubes 98, 98′. Springs 120, 120′ urge vacuum tool 40 through their connection to handle assembly 60 against the surface being cleaned when gripper stop 106 is moved clockwise, when viewed as shown in FIGS. 3*a* or 3*b*. Thus, tool 40 can clean sloping surfaces as well as horizontal and vertical surfaces. Rear member 14 (FIG. 1*a*) and casters 44, 44′ act as an outrigger to maintain the stability of frame 10 and tool 40 during use.

In position 2, frame 10 and vacuum tool 40 require a minimum vertical clearance to clean under objects such as tables, projecting shelves, and so forth. For example, if tool 40 is a 12″ (30.5 cm) Kelly cleaning head, tool 40 had 10″ (25.4 cm) of compliance to manipulator 152 when in position 2.

As robot arm 150 moves back and forth, frame 10 bearing vacuum tool 40 moves on casters 44, 44′ to vacuum a surface such as a floor. Robot arm 150 raises and lowers frame 10 as surfaces of different heights are encountered, enabling tool 40 to clean areas such as platforms, wells, stairs, table tops, shelves, and so forth. Manipulator 152 lowers handle assembly 60 and rotates it about axis A to enable tool clean under objects such as tables.

Figure 4A:
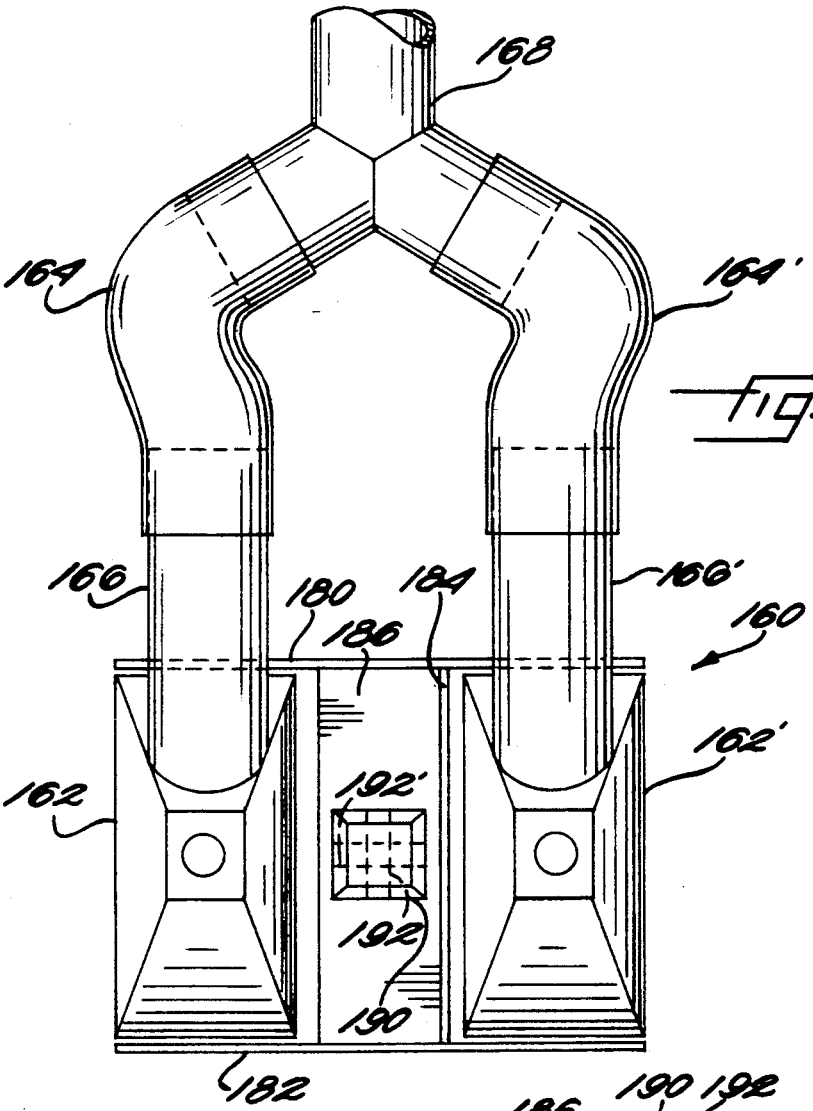
FIG. 4*a* is a top view of the frame of an apparatus according to an alternative embodiment of the present invention.
Figure 4B:
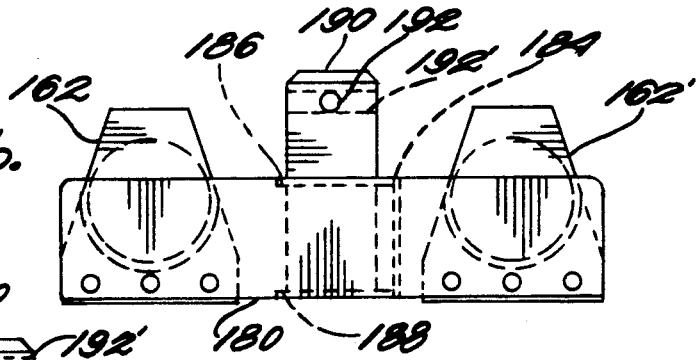
FIG. 4*b* shows an end view of the alternative embodiment shown in FIG. 4*a;*
Figure 4C:
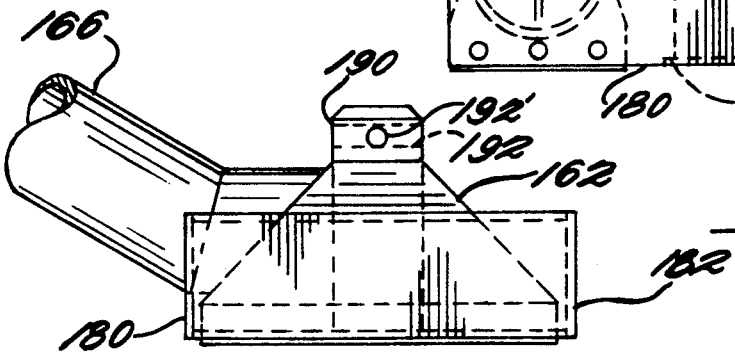
FIG. 4*c* shows a side view of the embodiment of FIG. 4*b;*

Frame 10 as described above accommodates a 12″ (30.5 cm) Kelly Decon System floor cleaning tool. It will be evident that a frame according to the present invention can readily be sized to accommodate other tools, including a 6″ (15.2 cm) Kelly wall cleaning tool. Handle assembly 60 can be used with any size frame that has a post 22. If desired, the frame may hold two 6″ Kelly wall cleaning tools 162, 162′ as shown in FIG. 4*a*, 4*b* and 4*c*. Hoses 164, 164′ join tubes 166, 166′ to "Y" connector 168, so the two tools can be used with a single Kelly unit.

Figure 4D:
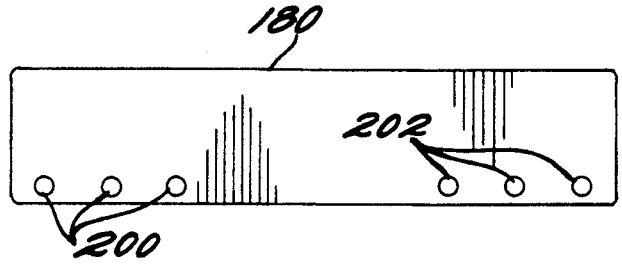
FIG. 4*d* shows a first side of the frame of the alternative embodiment shown in FIG. 4*a;*
Figure 4E:
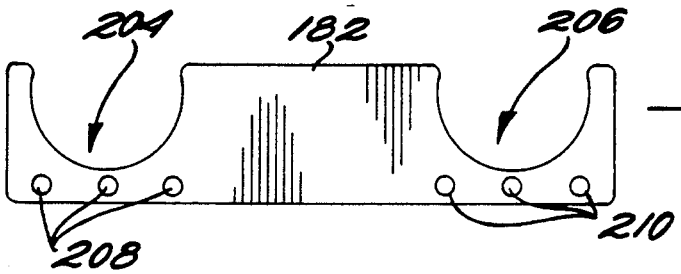
FIG. 4*e* shows a second side of the frame of the embodiment of FIG. 4*a*.

Frame 160 has side members 180, 182, joined by central support member 184 and post braces 186, 188 (FIG. 4*b*). Post 190 is attached to braces 186, 188. Post 190 has two substantially perpendicular holes 192, 192′ extending therethrough. Side views of members 180 and 182 are shown in FIGS. 4*d* and 4*e*, respectively. Side member 180 ( FIG. 4*d*) is generally rectangular, with holes 200 and 202 as shown. Side member 182 (FIG. 4*e*) has two generally semi-circular openings 204, 206 to accommodate the hoses of two Kelly wall cleaning tools, and holes 208, 210. Vacuum tools 160, 162 are attached to side members 180, 182 by screws at holes 200 and 208, and holes 202 and 210, respectively.

Frame 160 is made of ⅛″ (0.318 cm) stainless steel, dimensioned to accommodate wall cleaning tools 160, 162, each measuring approximately 6″×3″ (15.2×7.6×7.6 cm). Thus, side members 180, 182 measure about 9″×2″ (22.9×5.1 cm) and central support member 184 about 6″×2″ (15.2×5.1 cm). Openings 204, 206 have radii of 1.125″ (about 2.9 cm).

The Kelly Decon System vacuum tools are designed for manual operation, preferably on smooth surfaces. The tools are provided with wheels to facilitate movement and help maintain a small separation between the tool and the surface being cleaned. As manufactured, these tools are not suitable for use on rough surfaces such as concrete.

Figure 5:
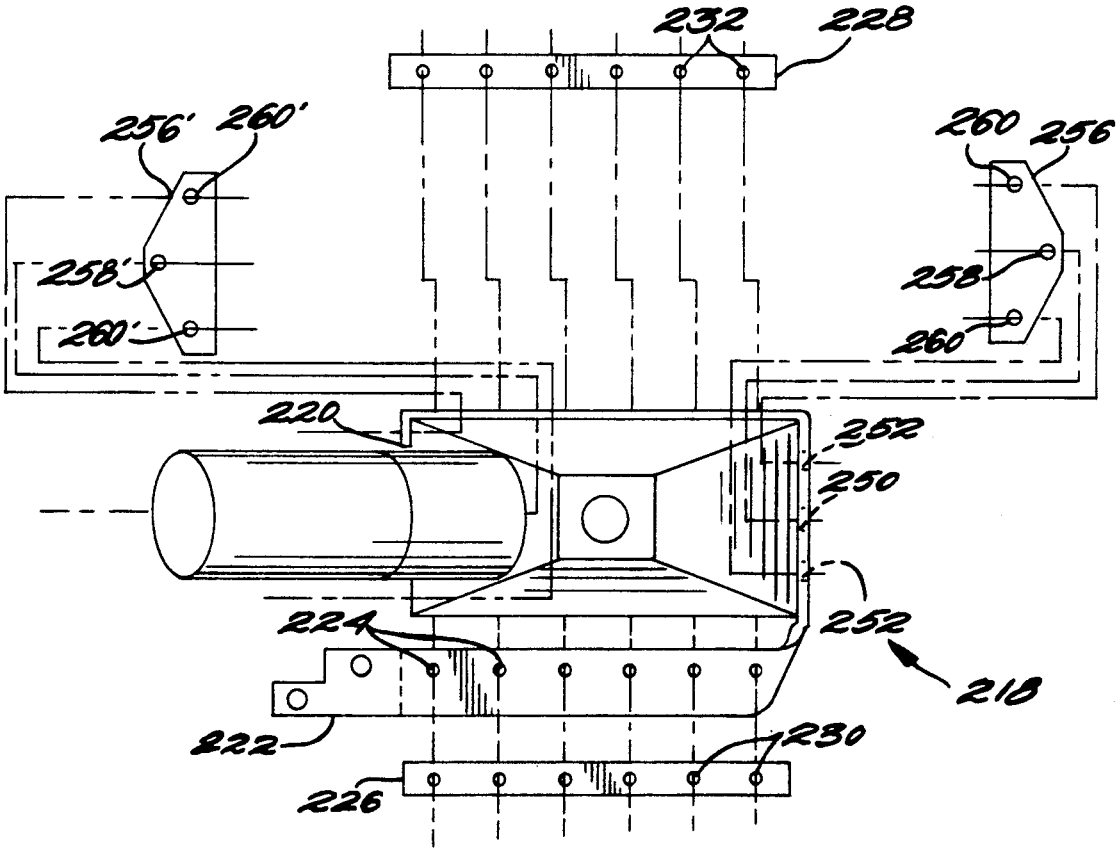
FIG. 5 is an exploded view of the vacuum tool adapter used with a preferred embodiment of the present invention.

An adjustor frame 218 is provided as an alternative embodiment to frame 10 of FIG. 1*a* to raise the Kelly vacuum tool 220 slightly for use on rough surfaces, as shown exploded view in FIG. 5. Adjustor frame 218 includes rubber skirt 222 and backing plates 226, 228, 256 and 256′ secured to Kelly vacuum tool 220. Frame 218 is shown in FIG. 5 as conforming to Kelly vacuum tool 220, however, it will be apparent that frame 218 can be of the same configuration as frame 10 in FIG. 1*a*.

By using an apparatus according to the present invention, a mobile robot can be adapted for remote decontamination procedures. Modifications to the Kelly Decon System tools consist of removing the manual handle and providing means for attaching the cleaning head to frame 10. No modifications are required to operate the Kelly system. By suitably controlling robot 150, an operator can decontaminate horizontal, vertical, or sloped surfaces without exposure to hazardous material present in the area. The robot can be used for other tasks once cleaning is accomplished.

It will be apparent to those skilled in the art that many changes and substitutions can be made to the preferred embodiment herein described without departing from the spirit and scope of the present invention as defined by the appended claims.

What is claimed is:

1. An apparatus for attaching a cleaning tool to a robotic manipulator, said apparatus comprising:

a frame;

means for attaching said tool to said frame; and means for connecting said frame to said manipulator so that said tool can be used on a vertical, horizontal or sloped surface.

2. The apparatus as recited in claim 1, wherein said connecting means releasably connects said frame to said manipulator.

3. The apparatus as recited in claim 1, wherein said connecting means pivotally connects said frame to said manipulator.

4. The apparatus as recited in claim 1, wherein said connecting means further comprises:

a handle having a first end and a second end, said first end adapted to be gripped by said manipulator; and means for connecting said second end of said handle to frame.

5. The apparatus as recited in claim 4, wherein said connecting means is releasably connecting.

6. The apparatus as recited in claim 4, wherein said connecting means is pivotally connecting.

7. The apparatus as recited in claim 4, wherein said second end of said handle connects to one of a plurality of positions on said frame.

8. The apparatus as recited in claim 4, wherein said frame has at least two casters.

9. An apparatus for attaching a cleaning tool to a robotic manipulator, said apparatus comprising:

a frame;

a handle having a first end and a second end, said first end adapted to be gripped by said manipulator;

means for connecting said second end of said handle to said frame; and means for attaching said tool to said frame.

10. The apparatus as recited in claim 9, wherein said connecting means releasably connects said second end of said handle to said frame.

11. The apparatus as recited in claim 10, wherein said connecting means pivotally connects said second end of said handle to said frame in a preselected position of a plurality of positions.

12. The apparatus as recited in claim 9, wherein said connecting means pivotally connects said second end of said handle to said frame.

13. The apparatus as recited in claim 9, wherein said connecting means connects said handle to said frame in a preselected position of a plurality of positions.

14. The apparatus as recited in claim 13, wherein said connecting means pivotally connects said second end of said handle to said frame.

15. The apparatus as recited in claim 9, further comprising casters.

16. The apparatus as recited in claim 9, wherein said attaching means releasably attaches said tool to said frame.

17. An apparatus for attaching a cleaning tool to a robotic manipulator, said apparatus comprising:

a frame having two side members, a rear member, and a support member;

a handle having a first end and a second end, said first end adapted to be gripped by said manipulator;

means for releasibly connecting said second end of said handle to said support member; and means for attaching said tool to said side members so that said tool is carried between said side members.

18. The apparatus as recited in claim 17, wherein said connecting means connects said second end of said handle to said support member at a preselected position of a plurality of positions.

19. The apparatus as recited in claim 17, wherein said connecting means pivotally connects said second end of said handle to said support member.

20. The apparatus as recited in claim 17, wherein said frame further comprises casters.

* * * * *